United States Patent [19]

LaFave

[11] Patent Number: 4,535,568

[45] Date of Patent: Aug. 20, 1985

[54] BELT SANDER

[76] Inventor: Charles H. LaFave, 11500 SW. Denny Rd., Beaverton, Oreg. 97005

[21] Appl. No.: 553,046

[22] Filed: Nov. 18, 1983

[51] Int. Cl.[3] ..... B24B 21/00

[52] U.S. Cl. ..... 51/148; 474/117; 474/138; 51/141

[58] Field of Search ..... 51/135 R, 141, 148; 198/814, 816; 474/112, 117, 136, 138

[56] References Cited

U.S. PATENT DOCUMENTS

| | | | |
|---|---|---|---|
| 266,257 | 10/1882 | Hanson | 51/135 R |
| 1,108,176 | 8/1914 | Hormel | 51/148 |
| 2,184,801 | 12/1939 | McCarthy | 474/112 X |
| 2,562,229 | 7/1951 | Bell | 51/141 |
| 2,724,934 | 11/1955 | Urquhart | 51/135 R |
| 4,115,957 | 9/1978 | Porth et al. | 51/148 X |
| 4,204,371 | 5/1980 | Horwitz | 51/141 |

FOREIGN PATENT DOCUMENTS

| | | | |
|---|---|---|---|
| 849366 | 7/1952 | Fed. Rep. of Germany | 51/135 R |
| 936617 | 11/1955 | Fed. Rep. of Germany | 51/148 |

*Primary Examiner*—Robert P. Olszewski

*Attorney, Agent, or Firm*—Daniel J. Bedell

[57] ABSTRACT

A belt sander having a vertically slotted casing for receiving an idler shaft; a crowned idler pully rotatably mounted on the idler shaft; a crowned, power driven drive pully rotatably mounted on the casing; a guide shaft attached perpendicular to the idler shaft; a first alignment plate attached to the casing interior; a second alignment plate slideably mating the casing interior between the first alignment plate and the idler shaft, said plates being bored to slideably receive the guide shaft; and a spring mounted in compression between the alignment plates.

7 Claims, 5 Drawing Figures

BELT SANDER

FIELD OF THE INVENTION

The present invention relates to abraiding, burnishing and polishing tools and more particularly to improvements in bench and floor mounted sanders of the type wherein an endless belt having an abrasive-coated outer surface is trained about spaced apart, rotating pulleys.

BACKGROUND OF THE INVENTION

In the prior art it has been common for belt sanders to require manual adjustment of pulley alignment for belt tracking. Such manual adjustment is often difficult, inconvenient and time-consuming. Alignment adjustment is usually required after belt replacement. Alignment readjustment may be required during sander operation. In belt sanders having no provision for manual adjustment of pulley alignment, it has been common to equip belt pulleys with edgewise flanges to assist in belt tracking but friction between pulley flanges and belt often causes rapid belt wear. In addition, the prior art devices are of rather complicated construction resulting in increased expense, both in material cost and assembly and in increased opportunity for malfunction.

SUMMARY OF THE INVENTION

Bearing in mind the foregoing, it is among the primary objects of the present invention to provide a new and improved belt sander, which eliminates the disadvantages and drawbacks of prior art belt sanders.

A feature of the present invention lies in provision of such novel and improved belt sanders having permanently aligned unflanged belt pulleys.

Another feature of the present invention is provision of such novel and improved belt sanders with means for belt tensioning and detensioning permitting rapid replacement of belts.

Other features of the present invention are provision of such novel and improved belt sanders wherein means for firmly supporting the belt against an article being sanded and means for supporting the article being sanded comprise modular subassemblies easily attached to and removed from the sander casing.

The invention resides in the combination, construction, arrangement and disposition of the various component parts and elements incorporated in improved belt sanders constructed in accordance with the principles of this invention. The present invention will be better understood and objects and important features other than those specifically enumerated above will become apparent when consideration is given to the following details and description, which when taken in conjunction with the annexed drawings describes, discloses, illustrates, and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved especially if they fall within the scope and spirit of the subjoined claims.

DETAILED DESCRIPTION OF THE PREFERRED EMBODIMENT

Figure 1:
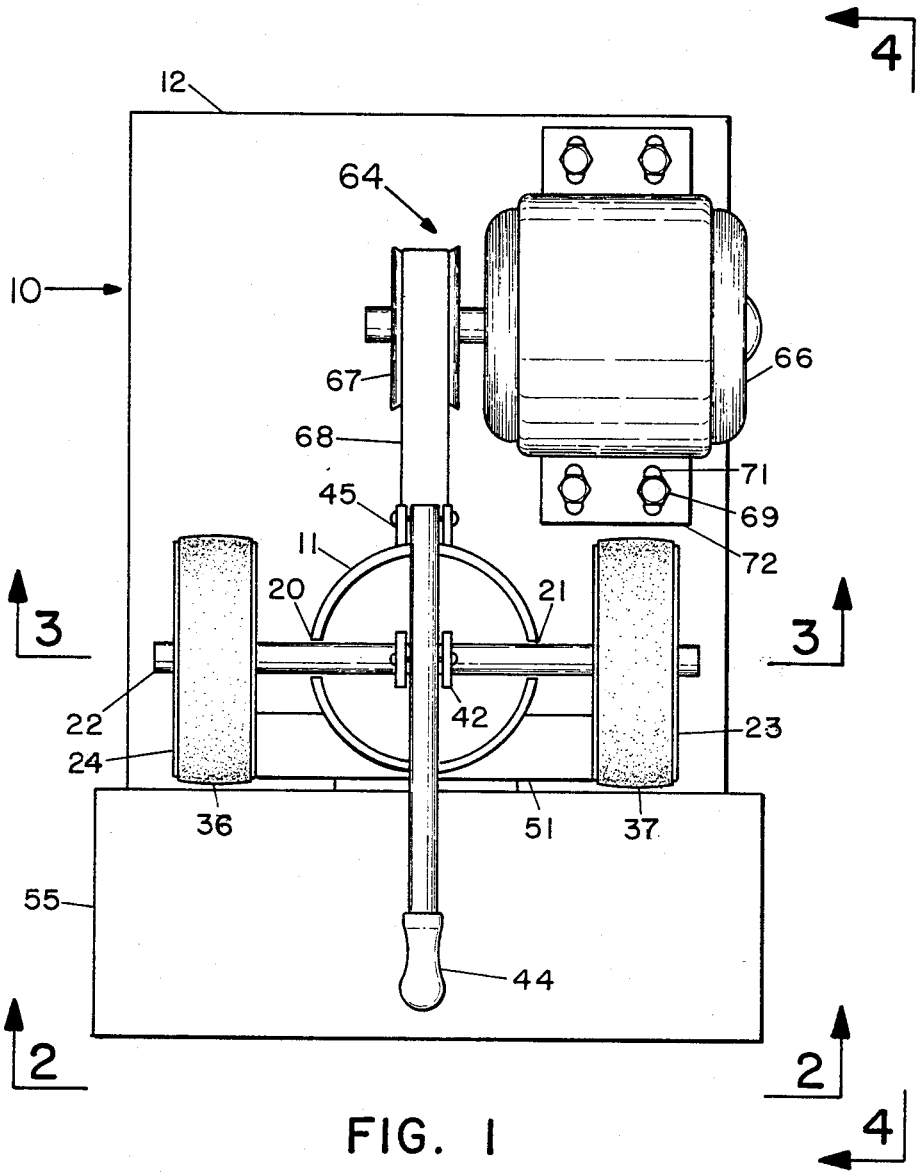
FIG. 1 is a top plan view of the device according to the present invention.
Figure 2:
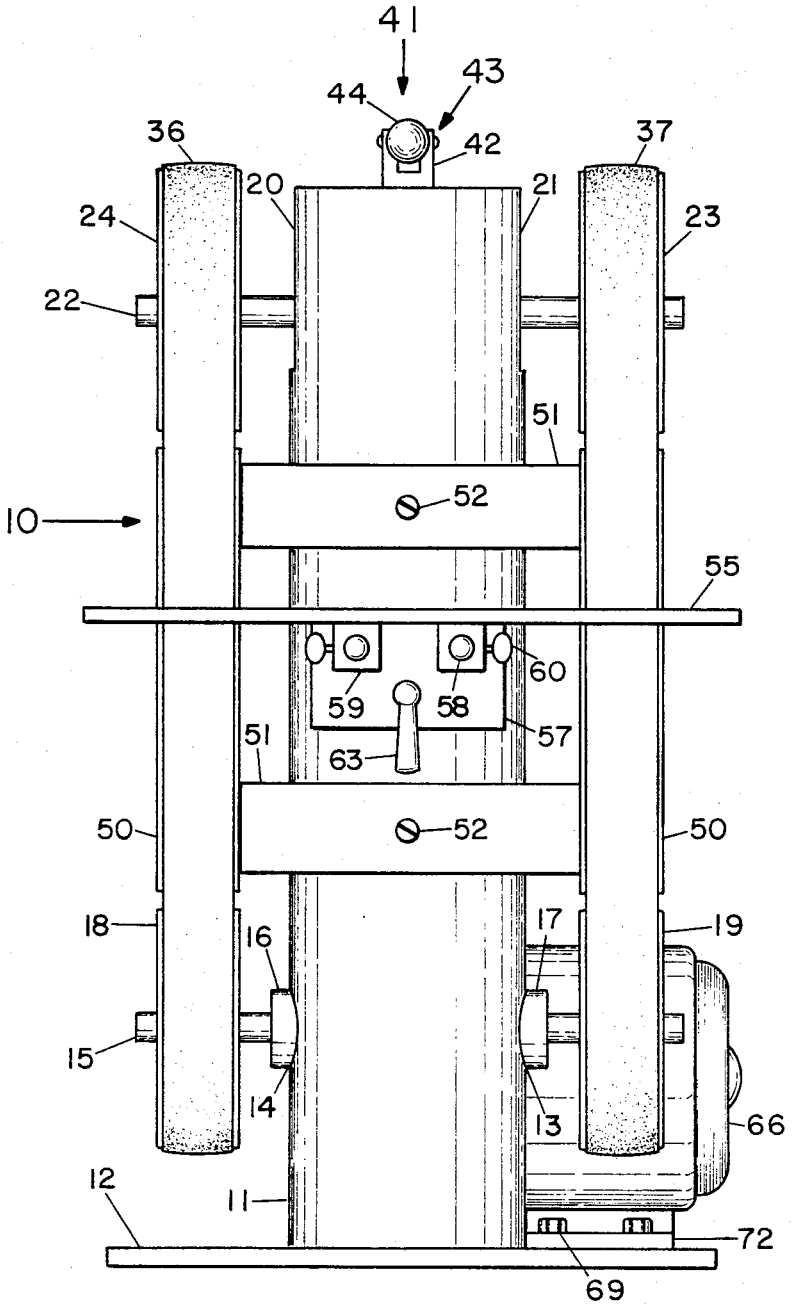
FIG. 2 a front elevational view of the device taken substantially along line 2—2 of FIG. 1.

Referring now to the drawings in detail, there is depicted a belt sander in accordance with the present invention designated generally by reference character 10. In FIG. 2, sander 10 is shown as having a vertical casing 11 mounted on base 12. In the preferred embodiment casing 11 is depicted in FIGS. 1 and 2 as having a generally cylindrical shape. However, the invention is not limited to the use of cylindrical casings but may, as by example, incorporate casings of rectangular or such other obviously appropriate cross-sections.

Figure 3:
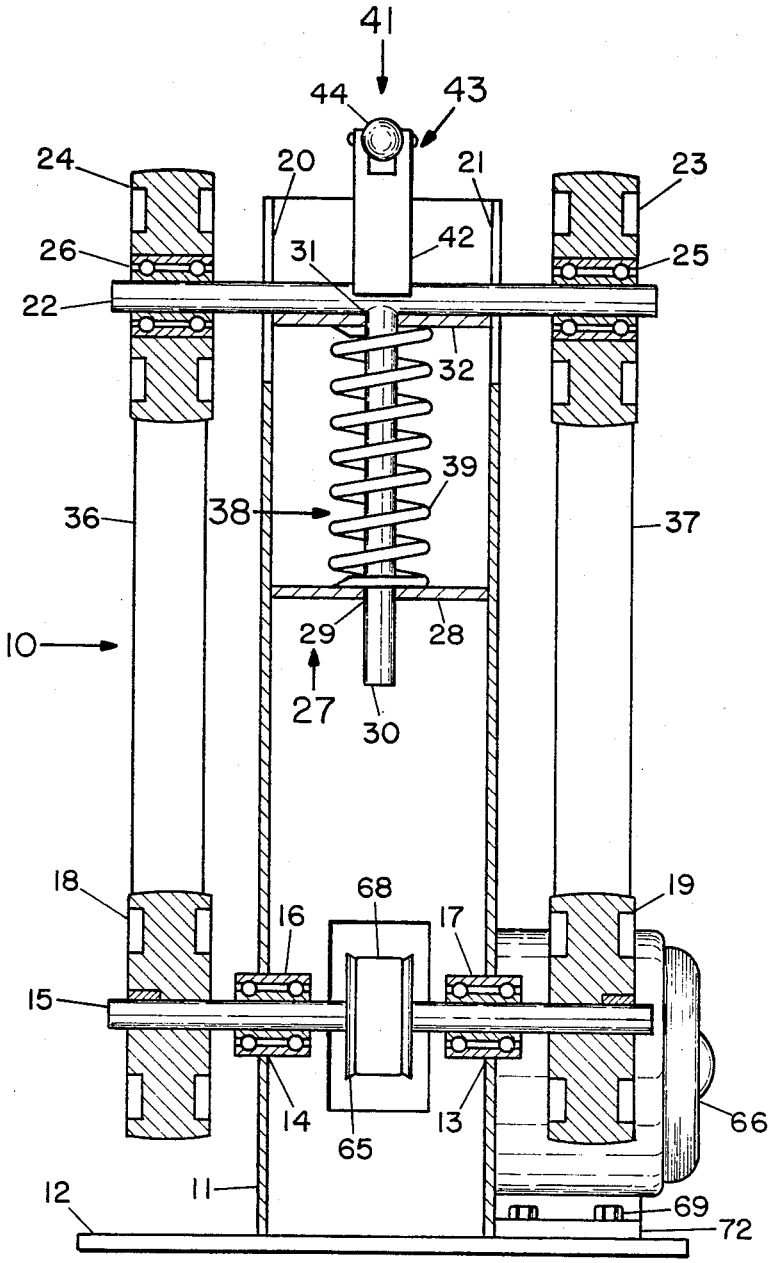
FIG. 3 is a front elevational view of the device, taken substantially along line 3—3 of FIG. 1, with portions thereof depicted in broken away section.

Turning now to a description of the pulley alignment mechanism of the present invention with specific reference to FIG. 3, it can be seen, piercing the lower end of casing 11, two opposing casing holes 13 and 14 aligned on a single, horizontally disposed, radial axis. Drive shaft 15, journaled by drive shaft bearings 16 and 17, is rotatably mounted through casing holes 13 and 14. Drive pulleys 18 and 19 are keyed to opposite ends of drive shaft 15 for rotation therewith.

Cut into the upper end of casing 11, two opposing vertical casing slots 20 and 21 are aligned directly above casing holes 13 and 14 respectively. Idler shaft 22 passes through casing slots 20 and 21, the width of casing slots 20 and 21 being sized to slideably fit idler shaft 22 allowing vertical movement of idler shaft 22 within slots 20 and 21. Idler pulleys 23 and 24, journaled by idler bearings 25 and 26, are mounted on opposite ends of idler shaft 22 directly above drive pulleys 18 and 19.

Casing holes 13 and 14 and casing slots 20 and 21 are aligned to insure that the radial axes of drive and idler shafts 15 and 22 remain within the same vertical plane. To insure that the radial axis of idler shaft 22 is held parallel to the radial axis of drive shift 15 within said vertical plane, means, generally designated by reference character 27, are provided for holding the axis of idler shaft 22 horizontal.

In the preferred embodiment as seen in FIG. 3, holding means 27 includes lower alignment plate 28 and upper alignment plate 32 in combination with guide shaft 30. Lower alignment plate 28, attached to the interior of casing 11, has a vertical bore 29 with radial axis perpendicular to, and in the same vertical plane, as the radial axis of drive shaft 15. Upper alignment plate 32, slideably fitting the interior of casing 11, has a similar vertical bore 31. Guide shaft 30 passes slideably through vertical bores 29 and 31 and is attached at the upper end to idler shaft 22 such that the radial axis of idler shaft 22 is held perpendicular to the radial axis of guide shaft 30.

Figure 4:
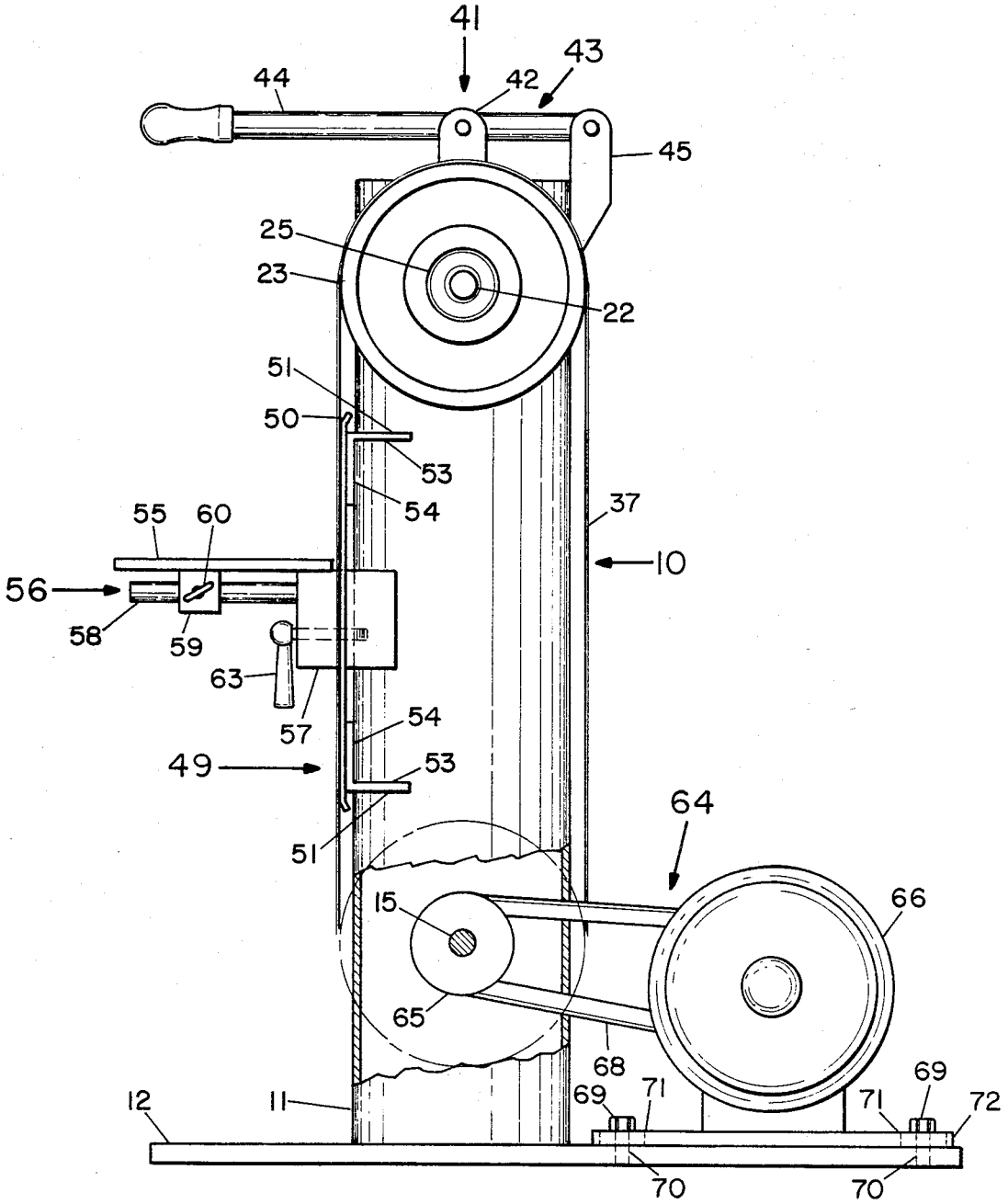
FIG. 4 is a side elevational view of the device, taken substantially along line 4—4 of FIG. 1, with a portion of the drive pulley and casing broken away to expose the elements therebelow.

As seen most clearly in FIGS. 2 and 4, a first endless belt 36, having an outer abrasive surface for contacting an article to be sanded, is trained about drive and idler pulley pairs 18 and 24 for rotation therewith. A second endless, abrasive belt 37 is trained about drive and idler pulley pairs 19 and 23 for rotation therewith. In the preferred embodiment, all drive and idler pulleys are crowned, having larger diameters at their centers than at their edges. The crowning of the pulleys facilitates tracking of the endless belts upon the pulleys during rotation therewith particularly when there are small imperfections in pulley alignment or in belt warp.

In reference to the second aspect of the present invention wherein an improved belt tensioning means, generally designated by reference character 38, as seen in FIG. 3, includes spring means 39 mounted in compression between lower alignment plate 28 and upper alignment plate 32. Spring means 39 upwardly biases guide shaft 30 forcing idler shaft 22 to move upward within casing slots 20 and 21 thus increasing the distance between opposing drive and idler pulleys with said upward movement limited by belts 36 and 37. At said limit of upward movement of idler shaft 22, belts 36 and 37 are held tightly about the drive and idler pulleys with tension in belts 36 and 37 dependant upon the stiffness of spring means 39.

Turning now to a description of the third aspect of the present invention wherein an improved belt detensioning means, generally designated by reference character 41, as seen in FIGS. 1, 3 and 4, includes plunger 42 positioned above the idler shaft and means, generally designated by reference character 43, for depressing plunger 42. In the preferred embodiment, plunger depressing means 43 includes manually operable lever arm 44, with center portion pivotally attached to the top of plunger 42 and end portion pivotally mounted to upright 45, attached to the side of casing 11. As lever arm 44 is depressed, plunger 42 engages and depresses idler shaft 22 decreasing distance between drive and idler pulleys thereby releasing tension in belts 36 and 37. Releasing lever arm 44 allows idler shaft 22 to rise under pressure from tensioning means 38 to restore tension in belts 36 and 37 in the manner previously described.

Figure 5:
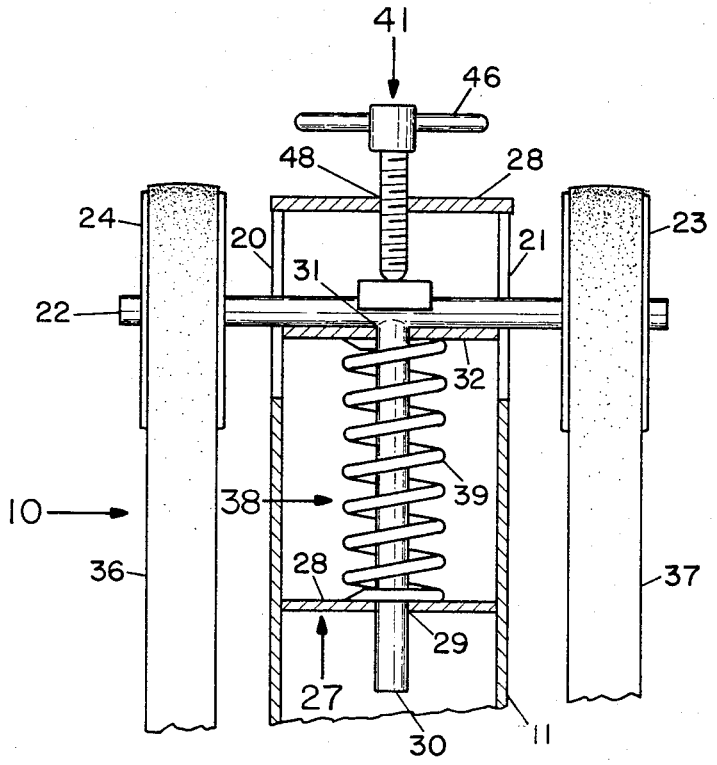
FIG. 5 is a partial front elevational view of the device according to the present invention, with portions thereof depicted in broken away section, showing alternate means for releasing tension in the belt.

It is understood that the invention described herein may incorporate alternative belt detensioning means 41 including, as by example seen in FIG. 5, threaded plunger 46 in combination with cap 28. Cap 28, attached to the top of casing 11, has a threaded vertical bore 48 aligned above idler shaft 22 for receiving plunger 46. As plunger 46 is rotated in one direction, plunger 46 moves downward engaging and depressing idler shaft 22 decreasing distance between drive pulleys 18 and 19 and idler pulleys 23 and 24 thereby detensioning belts 36 and 37. Rotation of plunger 46 in the opposite direction allows idler shaft 22 to rise under pressure from tensioning means 38 to restore tension in belts 36 and 37. One advantage of alternate means 41 is in permitting adjustment of belt tension by control of upward travel of idler shaft 22 under pressure from tensioning means 38.

In the fourth aspect of the present invention, means, generally designated by reference character 49 in FIGS. 2 and 4, are provided for supporting belts 36 and 37 against contact by articles being sanded. In the preferred embodiment, belt support means 49 includes contact shoes 50 for engaging the inner surfaces of belts 36 and 37, and angle pieces 51 each having a first leg 53 shaped to mate with the contour of casing 11, and having a second leg 54 attached to each shoe 50 for support thereof. The angle pieces 51 are attached to the casing by bolts 52.

In a fifth aspect of the present invention means, generally designated by reference character 56 in FIGS. 2 and 4, are provided for supporting articles being sanded. In the preferred embodiment, article support means 56 includes mounting block 57, shaped to mate with the contour of casing 11 and attached thereto by bolt 63, positioning shafts 58 attached to mounting block 57, guide blocks 59 bored to slideably receive positioning shafts 58, set screws 60 for releaseably fixing the position of guide blocks 59 along positioning shafts 58, and surface plate 55 attached to guide blocks 59.

Turning now to a description of the drive shaft rotating means, generally designated by reference character 64 as seen in FIGS. 1, 3 and 4, in the preferred embodiment, rotating means 64 includes contact pulley 65 keyed to drive shaft 15 for rotation therewith, driven by motor 66 through attached master drive pulley 67 and drive belt 68. Bolts 69 pass through base slots 71 in motor base 72 and into threaded holes 70 in casing base 12. With bolts 69 loosened, motor 66, attached to motor base 72 may be moved towards or away from contact pulley 65 to adjust tension in drive belt 68. Bolts 69 may then be tightened to fix position of motor 66.

Although a preferred embodiment of the present invention has been disclosed and described, changes will obviously occur to those skilled in the art. For instance, while in the preferred embodiment, sander 10 is depicted as simultaneously operating two belts 36 and 37, it is understood that the invention may operate with only a single belt 36 or 37 mounted in place on the sander. Further, the invention may, in another embodiment, incorporate only a single set of drive and idler pulleys and associated abrasive belt. It is therefore intended that the present invention is to be limited only by the scope of the appended claims.

I claim:

1. A belt sander comprising:

a vertical casing having two horizontally opposing vertical slots;

an idler shaft passing through said slots;

a first idler pulley mounted external to the casing on one end of the idler shaft for rotation about an axis;

a first power driven, rotatable drive pulley, externally mounted on the casing, having a fixed, horizontally disposed rotation axis;

a lower alignment plate mounted in the interior of the casing and having a vertical bore;

an upper alignment plate slideably mating the interior of the casing and having a vertical bore;

a guide shaft slideably mating the vertical bores of the upper and lower alignment plates and attached to the idler shaft; and means for positioning the idler pulley rotational axis with respect to the drive pulley rotational axis to tension a belt trained about the drive and idler pulleys.

2. A belt sander according to claim 1, wherein said positioning means comprise spring means mounted in compression between the upper and lower alignment plates.

3. A belt sander according to claim 1 further comprising:

a second idler pulley mounted external to the casing on a second end of the idler shaft for rotation about an axis coincident with the rotational axis of the first idler pulley, and a second power driven rotatable drive pulley, externally mounted on the casing, and having a horizontally disposed radial axis coincident with the rotational axis of the first drive pulley.

4. A belt sander as in claim 1 wherein said slots are formed in one end of said casing such that said idler shaft may be removed from said slots when said belt is removed from said drive and idler pulleys.

5. A belt sander as in claim 1 wherein said casing is cylindrical in shape, said slots being formed in one end of said cylindrical casing such that said idler shaft may be removed from said slots when said belt is removed from said drive and idler pulleys.

6. A belt sander comprising:

a vertical casing having two horizontally opposed vertical slots;

an idler shaft passing through the slots;

a first and a second idler pulley rotatably mounted on opposite ends of the idler shaft, external to the casing, and having a shared rotational axis;

a first and a second power driven, rotatable drive pulley, mounted external to the casing, and having a shared, horizontally disposed, rotational axis;

a lower alignment plate mounted in the interior of the casing and having a vertical bore;

an upper alignment plate slideably mating the interior of the casing and having a vertical bore;

a guide shaft, slideably mating the vertical bores of the upper and lower alignment plates, and attached to the idler shaft; and spring means mounted in compression between the upper and lower alignment plates to tension belts trained about the drive and idler pulleys.

7. A belt sander comprising:

a cylindrical shaped casing having two horizontally opposing vertical slots;

an idler shaft passing through said slots;

an idler pulley mounted external to the casing on one end of the idler shaft for rotation about an axis;

a power driven, rotatable drive pulley, externally mounted on the casing, having a fixed, horizontally disposed rotation axis;

a circular lower alignment plate mounted within the casing and having a central vertical bore;

a circular upper alignment plate slidably mounted within the casing and having a central vertical bore;

a guide shaft slidably mating the vertical bores of the upper and lower alignment plates and attached to the idler shaft; and means for positioning the idler pulley rotational axis with respect to the drive pulley rotational axis to tension a belt trained about the drive and idler pulleys.

* * * * *